294-906 SR
M5711 XR 4,213,646

United States Patent [19]

Burton

[11] 4,213,646

[45] Jul. 22, 1980

[54] RADIOACTIVE SOURCE MANIPULATOR AND STOWAGE DEVICE

[75] Inventor: Charles A. Burton, Silver Spring, Md.

[73] Assignee: The United States of America as represented by the Secretary of the Navy, Washington, D.C.

[21] Appl. No.: 42,836

[22] Filed: May 29, 1979

[51] Int. Cl.[3] ..... B25B 11/00

[52] U.S. Cl. ..... 294/86 A

[58] Field of Search ..... 294/86 A, 1 R, 20, 21, 294/86 R, 27 R, 1 BA, 19 R; 176/37, 67, 30

[56] References Cited

U.S. PATENT DOCUMENTS

| | | | |
|---|---|---|---|
| 1,806,557 | 5/1931 | Grinnell | 294/21 |
| 4,049,307 | 9/1973 | Potts | 294/1 R |

*Primary Examiner*—James B. Marbert

[57] ABSTRACT

A radioactive source manipulator and stowage device comprising a cylindrical body provided wih a transverse socket at one end thereof and a cylindrical sleeve rotatable about the body. An aperture in the wall of the sleeve may be rotated into alignment with the socket to permit insertion and removal of a radioactive source and the sleeve can be rotated to displace the aperture from the socket in order to confine a radioactive source within the socket.

6 Claims, 2 Drawing Figures

RADIOACTIVE SOURCE MANIPULATOR AND STOWAGE DEVICE

BACKGROUND OF THE INVENTION

1. Field of the Invention

This invention relates generally to the handling and stowage of radioactive sources, and more particularly to a single device which may be used to manipulate radioactive sources and also to serve as an inner container for storing radioactive sources in a shielded container.

2. Description of the Prior Art

In the field of nuclear physics it is the general practice to test and calibrate nuclear instrumentation through the use of radioactive sources of predetermined emission rates. These sources are often in the form of an emitting substance encapsulated within a metal billet in the form of a right circular cylinder. The sources may be emitters of neutrons or hard radiation such as gamma rays. In either event, the intensity of the radiation being emitted by the source will be known. The radioactive sources will be used in various ways depending upon the nature of the instruments being tested or calibrated.

Problems will arise in the manipulation and stowage of the radioactive sources for obvious reasons. Manifestly, human operators cannot handle these radioactive sources directly because of the repeated exposure to excessive radiation. In the past, radioactive sources have been handled by means of extensible tongs when being moved from stowage in shielded containers to test equipment and vice versa. The use of such tongs reduces the amount of radiation to which the operator is exposed to acceptable levels by virtue of the inverse square law. However, such tongs in time become themselves radioactive and thus pose an additional stowage problem.

SUMMARY OF THE INVENTION

With the foregoing and other problems in view, the present invention contemplates a single device which may be used for both manipulation and stowage of radioactive sources. The invention comprises a cylindrical body having a transverse socket formed near one end thereof and having a portion of the other end of a reduced diameter and suitably configured to provide a handle for an operator. A thin walled sleeve encompasses the large diameter portion of the cylindrical body and is provided with an aperture which may be aligned with the socket to permit insertion and removal of radioactive sources into and from the socket. The sleeve may be rotated relative to the cylindrical body to cover the socket and confine the radioactive source therein for manipulation and stowage. Means are provided interconnecting the cylindrical body and the sleeve for limiting relative rotation therebetween and for retaining the sleeve on the cylindrical body.

STATEMENT OF THE OBJECTS OF THE INVENTION

It is a primary object of this invention to provide a new and improved manipulator for radioactive sources.

It is another object of this invention to provide a manipulator for radioactive sources which may also be used as a stowage device.

It is a further object of this invention to provide a hand held device with which radioactive sources may be safely and expeditiously manipulated and stored.

BRIEF DESCRIPTION OF THE DRAWINGS

Other objects, advantages, and novel features of the invention will become readily apparent upon consideration of the following detailed description when read in conjunction with the accompanying drawings wherein.

DESCRIPTION OF THE PREFERRED EMBODIMENT

Figure 1:
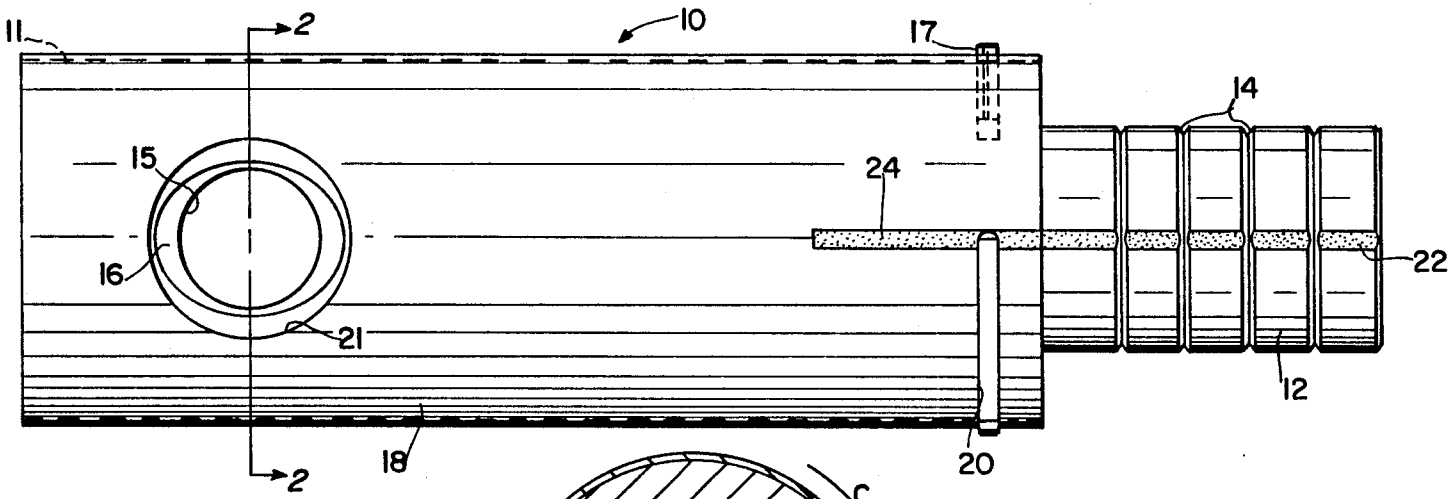
FIG. 1 is a lateral view of the radioactive source manipulator and stowage device of the present invention illustrating the principle features thereof.

Attention is now directed to the drawings, wherein like numerals of reference designate like parts throughout the several views, and more particularly to FIG. 1 wherein there is disclosed a raioactive source manipulating and stowage device designated generally by the reference numeral 10. The device 10 comprises a cylindrical body 11 having one end thereof of reduced diameter to define a handle 12. The handle 12 is provided with a plurality of circumferential grooves 14 to provide a hand gripping surface. Obviously the handle 12 could also be knurled or otherwise configured to facilitate a hand grip. At the end opposite the handle 12, the cylindrical body 11 is provided with a transversely disposed blind socket 15 which extends substantially through the body 11. The mouth of the socket 15 is countersunk at 16 to facilitate entry of radioactive sources into the socket.

A pair of spring or roll pins 17 are disposed in two holes formed in the body 11, adjacent the handle 12, and projected above the surface of the body 11. A thin walled cylindrical sleeve or tube 18 is disposed about the body 11 and rotatable relative thereto. The sleeve 18 is provided with a pair of diametrically opposed circumferential slots 20 which extend through an arc of approximately 90° and accomodate therein the free ends of the spring pins 17. The pins 17 and slots 20 limit relative rotation between the body 11 and the sleeve 18 to an angle of 90°. The sleeve 18 has a hole drilled in the wall thereof to define an aperture 21 which is somewhat larger in diameter than the socket 15. When the sleeve 18 has been rotated to the position shown in FIG. 1, the aperture 21 is axially aligned with the socket 15 and the socket is thus exposed for insertion or removal of a radioactive source. When the sleeve 18 is rotated to the other extreme of its permissible movement a portion of the wall of the sleeve 18 overlies the socket 15, and in effect, covers or closes the socket. The handle 12 and sleeve 18 are provided with painted or otherwise marked indicia 22 and 24, respectively, to indicate these relative positions of the body 11 and sleeve 18.

OPERATION

Figure 2:
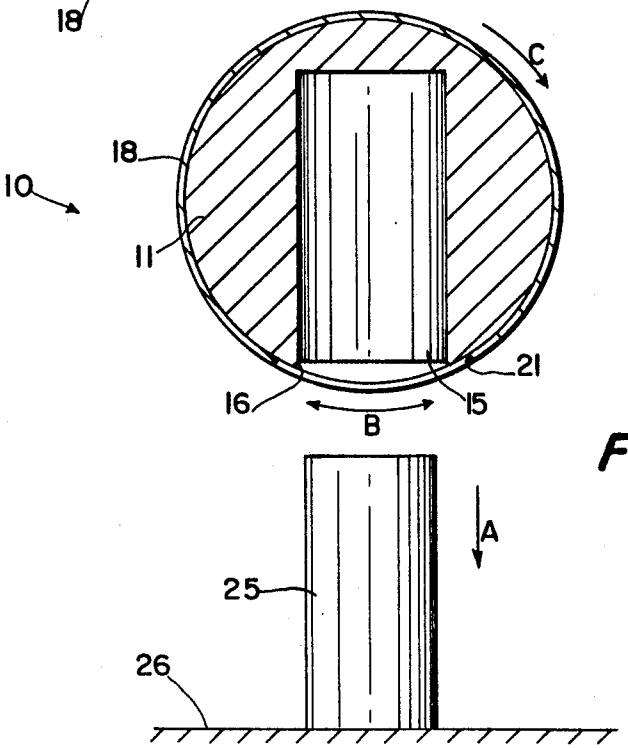
FIG. 2 includes a sectional view taken along the line 2-2 of FIG. 1 and illustrates the manner in which radioactive sources are manipulated utilizing the present invention.

In order that a better understanding of the invention might be had, its mode of operation will now be described. Referring now to FIG. 2, there can be seen a radioactive source 25, in the form of a right circular cylinder, resting upon a bench or other surface 26. The operator grasps the device 10 by the handle 12 and rotates the sleeve 18 until the parts assume the positions shown in FIG. 1. The device 10 is then lowered as indicated by the arrow A in FIG. 2, to insert the source 25 substantially all the way into the socket 15. The countersink 16 facilitates entry of the source into the socket. When the device 10 has been lowered until it contacts the surface 26 the device 10 is then rotated in either direction, as indicated by the arrow B, through an angle in excess of 90° until gravity seats the source 25 in the bottom of the socket 15. The socket 15 is of a diameter only slightly larger than the outside diameter of the source 25 so that the source will be frictionally engaged by the wall of the socket 15 and not fall out of the socket during the initial rotation of the device. Once the source 25 is bottomed in the socket 15, the sleeve 18 is rotated, relative to the body 11, as indicated by the arrow C in FIG. 2, until further rotation is restrained by the pins 17. This rotation displaces the aperture 21 from the mouth of the socket 15 so that a portion of the wall of the sleeve 18 covers the mouth of the socket. The device 10 together with the radioactive source 25 can then be lowered by means of the handle 12, into a shielded container for stowage until its use is again required. Obviously, the above procedure would be reversed to remove a source for test use.

From the foregoing, it will be readily apparent that the present invention posesses numerous advantages not found in prior art devices. For example, no separate manipulator is required since the manipulator is itself the stowage device. Thus there is no problem with radioactive tongs or other manipulating devices for which shielded stowage must be provided. Also, the present invention lends itself to one handled manipulation except for the single operation of covering or uncovering the stowage socket. Further, the present invention readily lends itself to use with various types of radioactive sources. The physical dimensions of the device would be determined using tables of acceptable exposure in conjunction with the known intensity of the sources to be manipulated. The materials selected for construction may be varied depending upon the nature of the source to be handled. For example, if neutron sources are to be manipulated, then the body 11 might best be made of a material such as polyethylene which is high in hydrogen atom content. On the other hand, if the source emits hard radiation such as gamma rays, then the body 11, or a portion thereof, such as the socket itself, might better be made of lead or steel.

Obviously many modifications or variations of the present invention are possible in the light of the above teachings and would readily occur to those skilled in the art. It is therefore to be understood that with the scope of the appended claims the invention may be practiced otherwise than as specifically described.

What is claimed is:

1. A radioactive source manipulator and stowage device comprising:

a cylindrical body;

a transversely disposed socket formed near one end of said cylindrical body for receiving a radioactive source;

a cylindrical sleeve rotatably mounted on said cylindrical body; and an aperture formed in the wall of said sleeve whereby rotation of said sleeve to axially align said aperture with said socket will permit a radioactive source to be inserted into and removed from said socket and rotation of said sleeve to move said aperture out of alignment with said socket when the socket contains a radioactive source readies the device for manipulation and stowage.

2. The device of claim 1 wherein said sleeve is provided with a plurality of circumferential slots and said cylindrical body is provided with pins radially projecting into said slots whereby the relative rotation between said sleeve and said cylindrical body is limited.

3. The device of claim 1 wherein said cylindrical body is of reduced diameter at the end opposite said socket to provide a handle whereby the device may be grasped and manipulated.

4. The device of claim 2 wherein said cylindrical body is of reduced diameter at the end opposite said socket to provide a handle whereby the device may be grasped and manipulated.

5. The device of claim 3 wherein said sleeve and said handle are provided with indicia to indicate alignment and non-alignment of said aperture with said socket.

6. The device of claim 4 wherein said sleeve and said handle are provided with indicia to indicate alignment and non-alignment of said aperture with said socket.

* * * * *